US005619755A

United States Patent [19]

Casartelli

[11] Patent Number: 5,619,755

[45] Date of Patent: Apr. 15, 1997

[54] INTEGRAL CRASH-HELMET FOR MOTORCYCLISTS AND THE LIKE TRANSFORMABLE INTO AN OPEN, JET-LIKE HELMET

[75] Inventor: Gabriele Casartelli, Clamart, France

[73] Assignee: E.D.C. Sarl, Issy-les-Moulineaux, France

[21] Appl. No.: 394,829

[22] Filed: Feb. 27, 1995

[30] Foreign Application Priority Data

Mar. 8, 1994 [EP] European Pat. Off. ..... 94103523

[51] Int. Cl.[6] ..... A42B 3/18

[52] U.S. Cl. ..... 2/424; 2/422

[58] Field of Search ..... 2/410, 411, 421, 2/422, 424, 425, 9

[56] References Cited

U.S. PATENT DOCUMENTS

| | | | |
|---|---|---|---|
| 4,024,587 | 5/1977 | Barford . | |
| 4,042,974 | 8/1977 | Morgan et al. . | |
| 4,769,857 | 9/1988 | Cianfanelli et al. | 2/424 |
| 5,093,939 | 3/1992 | Noyerie et al. | 2/424 |
| 5,412,810 | 5/1995 | Taniuchi | 2/424 |

FOREIGN PATENT DOCUMENTS

| | | | |
|---|---|---|---|
| 395845 | 11/1990 | European Pat. Off. | 2/421 |
| 2141431 | 1/1973 | France . | |
| 2595920 | 9/1987 | France | 2/425 |
| 2846636 | 4/1980 | Germany . | |
| 3143796 | 5/1983 | Germany . | |
| 8321097 | 10/1983 | Germany . | |
| 3744114 | 10/1988 | Germany | 2/425 |
| 2175490 | 12/1986 | United Kingdom . | |

*Primary Examiner*—C. D. Crowder
*Assistant Examiner*—Michael A. Neas
*Attorney, Agent, or Firm*—Collard & Roe, P.C.

[57] ABSTRACT

Integral crash-helmet for motorcyclists, sports-competitions and the like, transformable into a "Jet"-like open helmet, includes a frontally open rigid cap (1) and a rigid chin protector (3), removable and fastenable in seats (3*a*) provided in the two flanges (2–2*a*) protruding from the cap (1) base by the association of removable embedding and hand-operatable locks, provided correspondingly on the external faces of the flanges and on the internal faces of the chin protector. The removal of the chin protector (3) transforms the integral helmet, which complies with the stress-resistance requirements provided for integral helmets, into an open "Jet"-like helmet, and vice-versa.

15 Claims, 3 Drawing Sheets

INTEGRAL CRASH-HELMET FOR MOTORCYCLISTS AND THE LIKE TRANSFORMABLE INTO AN OPEN, JET-LIKE HELMET

This invention relates to an integral crash-helmet for motorcyclists, car-drivers, to be used on roads and on all terrains, provided with such means as to allow for its transformation into a "Jet"-like open helmet, and vice-versa, according to the needs and the types of utilization.

As is known, many types of protective helmets are available today for motocyclists and other users. Generally, they are constituted by a rigid cap, usually from suitably chosen plastic material, composite materials and the like, provided in the inside with a protective padding, for instance from expanded polystyrene, and by a comfort lining. The cap wraps around the head, leaving open, in some cases, the part corresponding to the face and the chin, while in other cases said cap is provided with a frontal chin and mouth protector. In this case, the helmet is said to be integral or closed and may have a transparent liftable visor.

In practice, the different crash-helmets are defined according to their specific utilization, namely: a) integral helmet, i.e. the one constituted by a practically entirely closed rigid cap, provided with a rigid front chin protector and possibly with a transparent visor; b) "Jet"-like helmet, constituted by a frontally open cap, i.e. a cap which is not provided with a chin protector.

In all-terrain competitions, such as motor-cross competitions, also a helmet provided frontally with a more protruding chin protector compared to that of integral helmets is preferably utilized.

It is also known that the so-called integral helmets must comply, to be marketed, with safety regulations which are agreed on also according to international agreements. In particular, integral helmets must withstand shocks and stresses of various kind, in order to safeguard as much as possible the integrity of the head of the user in case of falls and impacts.

Some types of helmets are known, in particular in the case of helmets equipped with a protruding chin protector, whose chin protector is not integral with the cap. It is applied to the latter by means of screws or is made from non rigid material, in order to protect the chin of the user from possible impact caused by alien objects, such as stones and the like, which may be lifted from the ground during all-terrain competitions. However, these helmets cannot satisfy the tests prescribed for their homologation as integral helmets and do not achieve therefore the safety ensured by the latter. At present, therefore, the types of helmets that can be defined as "integral" and that have the relevant characteristics are only those equipped with a rigid chin protector, lined in the same way as the cap, and practically integral with said cap.

DE-U-8321097 (HANS ROMER GMBH+CO) discloses a helmet for skiers, provided with a removable chin protector superimposed to the base of the duble through two edges protruding from the chin protector, and fixed by means of two connecting means placed along an axial line as farthest off as possible from each other in order to absorb the torsional stresses.

GB-A-2175490 (NOLAN S.p.A.) discloses an integral crash helmet provided with a basic unitary helmet body which is provided at its lower portion with a reinforcing covering suitably faceted in the region of its lower portion. This lower portion is recessed with respect to the upper portion and defines a curved surface meeting the spheroidal upper portion at a step. The reinforcing covering is attached to said lower portion of the basic body and is positioned with its upper edge in coincidence with the said step.

According to GB-A-2175490, the helmet can also be provided with a chin protector having a strap by which it can be anchored to an attachment adapted to be fitted to the basic body.

U.S. Pat. No. 4,042,974 (C. R. MORGAN ET AL.) discloses a face guard accessory for a motorcycle rider's helmet for shielding the nose, mouth and lower portions of the face from flying. It is constituted by a perforated shield provided with a pair of elongate side members connected to the shield by means of a longitudinal slot extending forwardly and anchoring clamps for fastening said side members.

U.S. Pat. No. 4,024,587 (J. C. BARFORD) discloses a full face safety helmet convertible to a coverage safety helmet and vice versa constituted by a coverage safety helmet and by a chin guard member adapted for cooperation with the lower part of the coverage. The chin guard member has the form of a closed loop with side walls inclined inwardly in a downwards direction.

FR-A-2141431 (R. FUKS) discloses a safety helmet constituted by a cap and by an additional member for protecting the mouth, the chin, the base of the cheeks and the lower part of the head. The additional member is constituted by a bent shell provided with snap fasteners for fixing the shell to the cap.

DE-A-3143796 (R. BERNER) discloses a safety helmet constituted by a cap and by a chin guard member in the form of a bent band provided with elongated elements at its both ends suitable to be inserted and fixed into corresponding slots provided at the base of the cap.

DE-A-2846636 (SCHUBERT-WERK GMBH & CO KG) discloses a safety helmet constituted by a cap and by a liftable chin guard member, rotatably applied to the cap.

An object of this invention is to realize an integral helmet for motorcyclists and the like, so designed and constructed as to allow its easy transformation into a "Jet"-like open helmet, whenever so required, and the restoring of the integral helmet structure having also the necessary characteristics of mechanical resistance and protection that are required by the safety regulations and in particular by the codified ones.

A further object of this invention is to realize a highly reliable and safe integral helmet that keeps the characteristics of safety and reliability even after many transformations from integral helmet to open helmet and vice-versa, with obvious advantages of both practical and economic nature.

Still a further object of this invention is to realize an integral helmet of the above specified type made from materials and cap and chin protector linings that are commonly utilized in the present integral helmets with a fixed chin-protector.

These and still further objects, which shall be more clearly emphasized by the following description, are achieved by a crash-helmet for motorcyclists and the like, which helmet comprises, according to this invention, a frontally open rigid cap and an also rigid and removable chin protector fastenable into seats provided in flanges protruding from the base of said cap by means of an association of snap coupling and holding devices, with hand-operatable stable locking means. These snap devices and said locking means are correspondingly provided on the opposing faces of said flanges protruding from the base of said cap and on the faces of the ends of said chin protector. This will realize the coupling between said flanges with said end of the chin protector thanks to the partial superposition of same, and to obtain, upon removal of the chin protector, a "Jet"-like open helmet. With the chin protector stably fastened to the cap, a helmet is provided that still has the characteristics required for its utilization and homologation as integral helmet.

More particularly, said coupling and holding devices are constituted by rectilinear ribs provided on the flanges of the cap and which slide on corresponding guides projecting from the end faces of the chin protector. There are also tangs provided on the chin protector which are snap-embeddable into corresponding windows provided in the cap flanges or by tangs provided on the cap flanges and snap-embeddable into windows provided in the ends of the chin protector.

The stable locking means are constituted by at least a bolt, a stud, a pin or the like fastenable by screwing, bayonet jointing or the like by means of hand-operatable means and which goes through said flanges and said ends superposed to one another.

The seats or superposed zones of said flanges protruding from the cap and those at the end of the chin protector have a reduced thickness to allow, upon superposition, maintaining the continuity of the external surface between the flanges and the chin protector. While the transversal end side of the chin protector ends is preferably realized according to a broken line, it forms a plurality of substantially wedge-shaped corners. Thus it is stably housed, both axially and transversally, within a corresponding wedge-shaped flaring provided frontally and transversally in the cap flanges.

Besides, in the seats or thinner zones provided with guides and windows on these flanges protruding from the cap, two plates or cover maskings are provided, according to this invention. They are opportunely shaped and have a corresponding outline, suitable to conceal said windows and said thinner zones when the helmet is utilized without chin protector. This is either for aesthetical reasons or for aerodynamic and safety reasons, to avoid the exposure of surface unevennesses and/or discontinuities.

Further characteristics and advantages of this invention shall be more clearly stressed by the description of an embodiment of same, wherein reference is made to the enclosed drawings, which are given by non limitative way of example, wherein:

FIG. 5 shows a side view of the chin protector only, while

With reference to said figures, the integral helmet transformable into a "Jet"-like open helmet, according to this invention, is substantially constituted by a cap 1, made from polycarbonate, fiberglass or other suitable materials, provided with a protective lining and a comfort lining.

Figure 1:
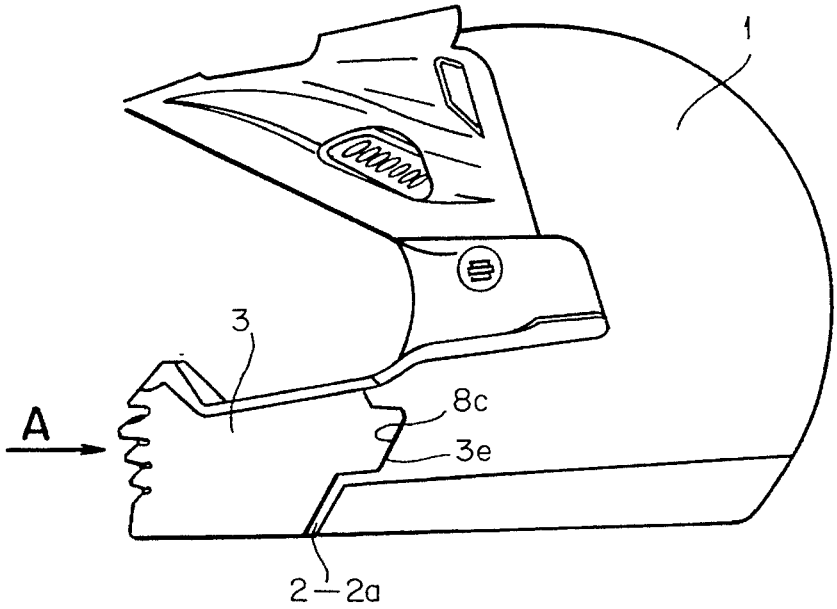
FIG. 1 shows, schematically and from a side view, an integral helmet which can be transformed into an open helmet, realized according to this invention.
Figure 2:
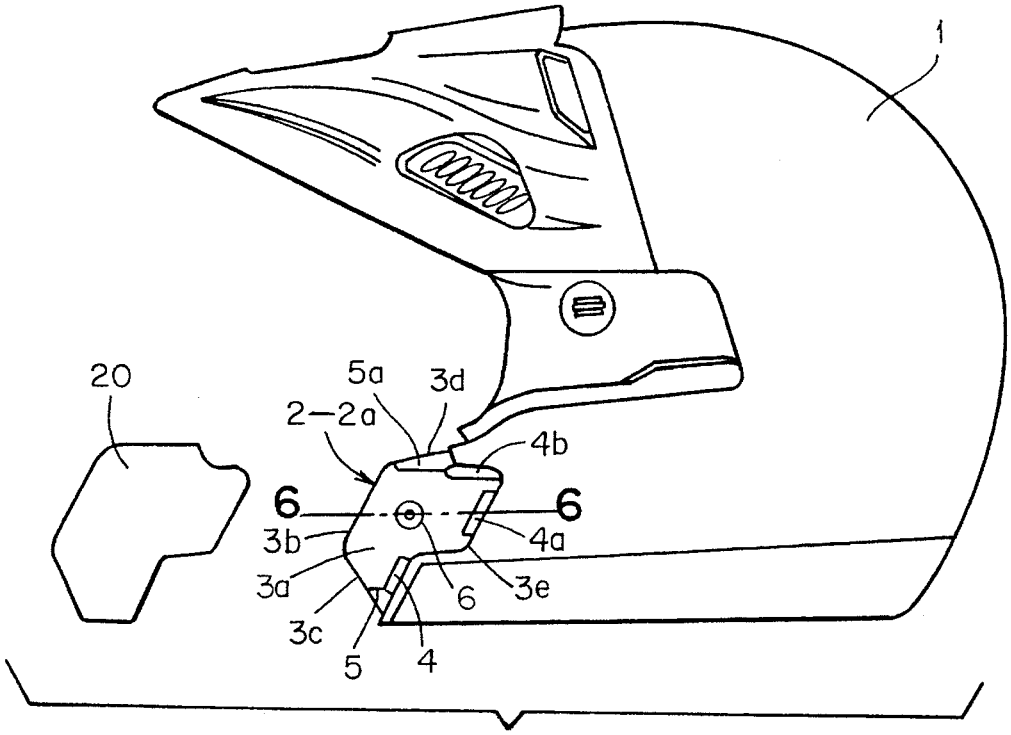
FIG. 2 shows the same helmet of FIG. 1, without chin protector and therefore utilizable as a "Jet"-helmet, with the plate or cover masking in exploded position.
Figure 3:
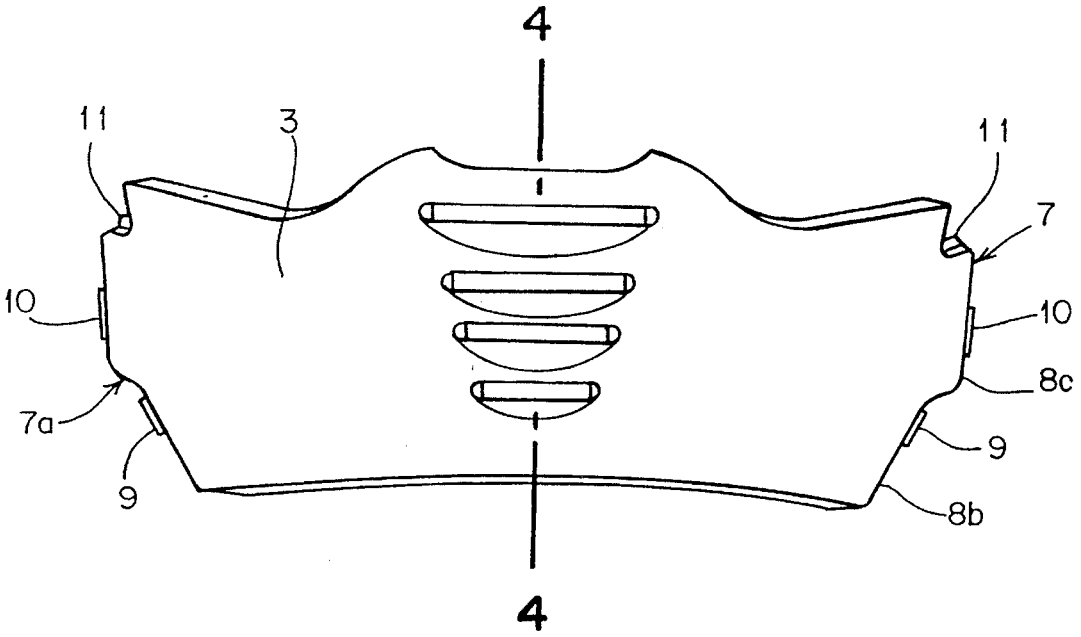
FIG. 3 shows a front view, according to the arrow A of FIG. 1, of the chin protector only, removed from the cap.

Laterally to the open zone of this type of helmet, two flanges are provided, according to this invention, indicated by 2–2*a* on FIGS. 1 and 2, which protrude from the base of cap 1. Said opposite flanges 2–2*a* constitute two flat seats for housing and stably but removably holding an arched chin protector 3. This protector may be made from the same materials and linings as the cap or also from different rigid materials, according to a sharp or anyhow markedly arched form.

To allow, according to this invention, the hooking and unhooking of the chin protector 3 to the cap, on both the opposing flanges 2–2*a* of said cap 1 and externally to same, two equal seats or zones 3*a* are provided, which are housed within the thickness of the flanges thanks to a reduction in the thickness of the latter (FIG. 2).

Each seat 3*a* has a polygonal shape, as it has externally a side 3*b* inclined relatively to the vertical, two opposing sides 3*c*–3*d*, rectilinear and differently inclined relatively to one another. The broken-line fourth side 3*e* is inclined is the opposing side 3*b* and contained within the flange, with ensuing formation of a plurality of corners along the broken line, suitable to constitute as many engagement and holding zones. Peripherally to the broken-line side 3*b* of seat 3*a*, three openings or windows 4–4*a*–4*b* are provided, having a substantially rectangular shape, as well as two opposing and parallel raised ribs 5–5*a* near the lower window 4 and the opposing upper window 4*b*. Said windows and said ribs are provided for guiding and embedding corresponding means provided at the end of the chin protector, as shall be more clearly explained hereafter.

Figure 6:
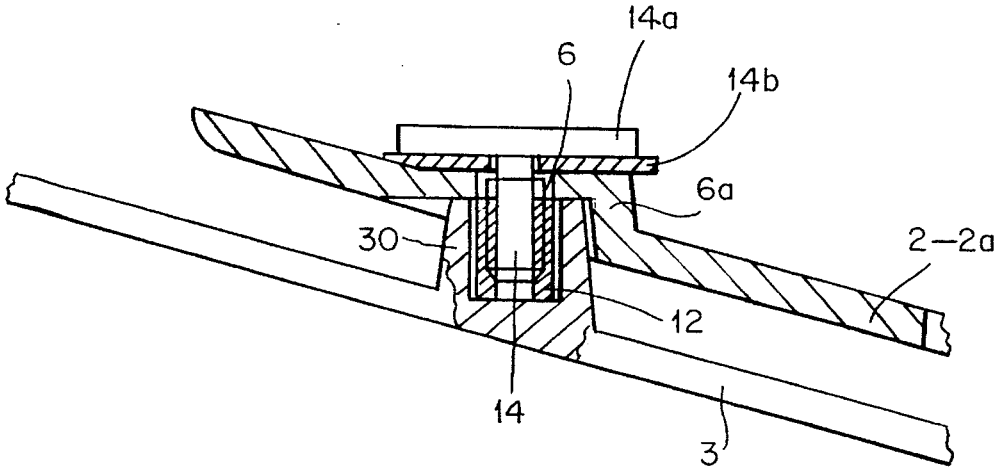
FIG. 6 shows a construction detail of the helmet subject matter of this invention, drawn from section 6—6 of FIG. 2.
Figure 5:
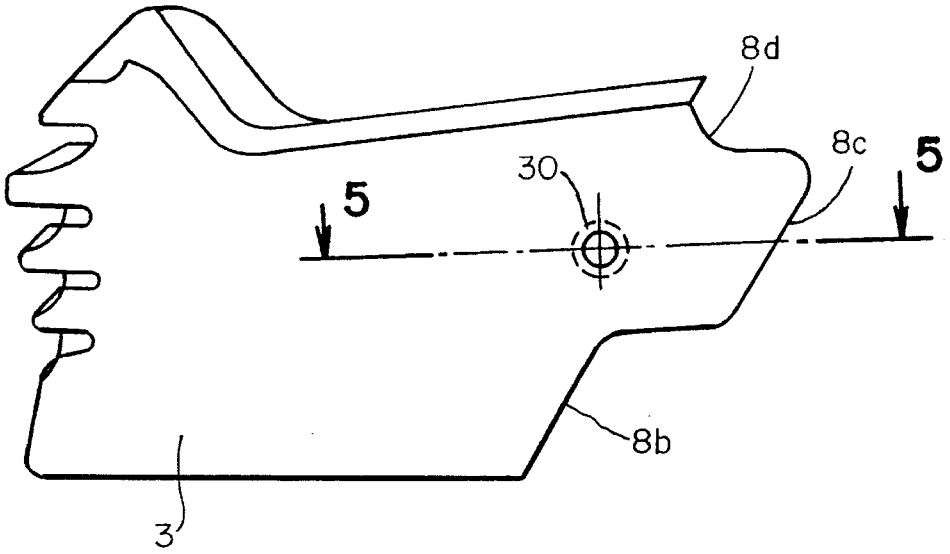
Figure 4:
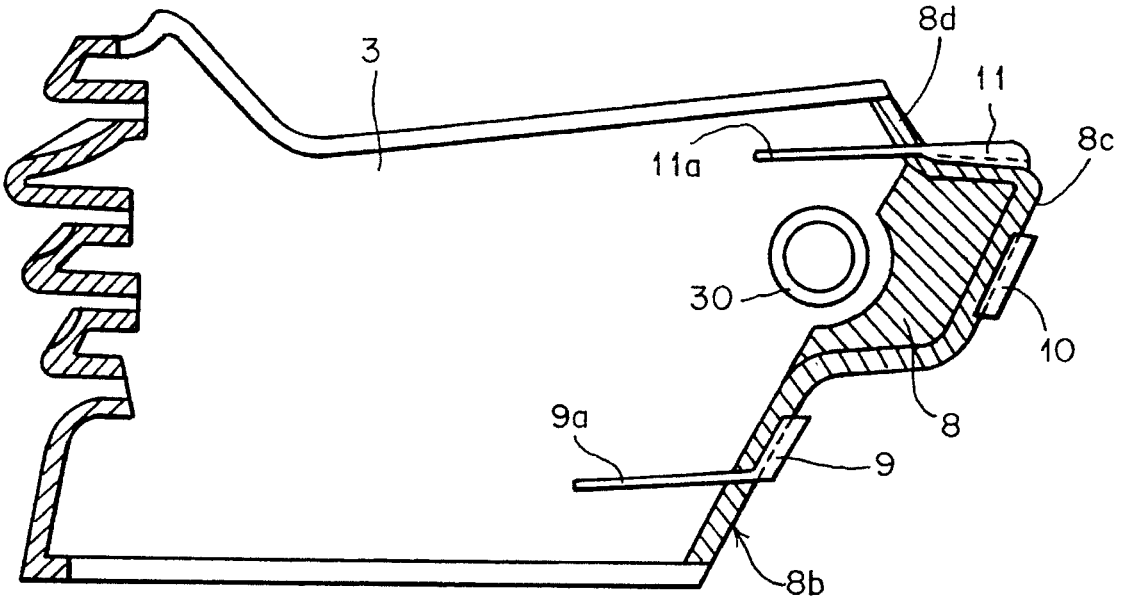
FIG. 4 shows a cross-section of the chin protector of FIG. 3, along the 4—4 line.

At each of the flat polygonal seats 3*a* a through-hole 6 is also provided for the passage of a bolt or a locking pin or the like, which is hand operatable by rotation or screwing, as shall be also better described later on. In each of the two ends 7–7*a* of the chin protector 3 a thinner seat 8 is provided (FIG. 4), and more precisely a zone whose thickness decreases towards the free end of the chin protector, which end is also realized as a broken line, i. e., it is made up by a rectilinear and inclined length 8*b*, followed by a length 8*c* and by a further upper end length 8*d*. The inclinations and dimensions of the broken line 8*b*–8*c*–8*d*, which constitutes the outline of the chin protector, are such as to correspond to the ones of the broken line of the polygonal seat 3*a* of the cap flanges. Besides, on the outside of said broken line three rectangular tangs 9–10 and 11 are provided, perpendicularly orientated towards the plane of seat 8. They are so positioned and sized as to allow their housing by a slight clearance within windows 4–4*a* and 4*b*, provided in the polygonal seat 3*a* of the cap flanges, upon coupling by superposition of the internal face of the chin protector ends on the external face of the cap flanges, as shown by way of example on FIG. 6. In correspondence of tangs 9 and 11, two parallel ribs 9*a* and 11*a* are also provided, so placed as to constitute insertion and holding guides between the protrusions 5*a* and 5 provided on flanges 2–2*a*.

Besides, above each decreasing-thickness zone 8 of the chin protector ends, in this type of embodiment, a length of tube 30 (FIG. 6) is provided which is integral with the internal face of the chin protector, whose axis is inclined, relatively to the perpendicular of said face, i.e. towards the arched part 3*f* of said chin protector. The axis of tube 30 coincides with the axis of hole 6 of the cap flanges, so as to allow a threaded bolt or a bayonet pin 14 to pass through to stably lock the end of the chin protector 3 to the cap flanges 2–2*a*. To allow the raised tube 30 to be coaxial with hole 6 of the cap flanges, hole 6 is provided on an inclined protrusion 6*a*, so shaped as to take into account the slight bending of flanges 2–2*a* (FIG. 6) and the chin protector ends. Also, a ring nut of threaded tubular insertion 12 is provided within said tube 30, to allow the screwing of the threaded bolt 14 by means of head 14*a* and the interposition of a washer or gasket from elastic material 14*b*. The interposition of said gasket of elastic material is very important as it ensures, according to this invention, that when one closes the locking means—in the case in point, the bolt—no excessive stress is exercised which would damage, in the long run, the locking seat of said means, alterating in this way the resistance characteristics required for the integral helmet.

The assembly of the chin protector on flanges 2–2a protruding from the cap base is made by superposing the chin protector ends 7–7a on the external faces of the two flanges, and guiding the chin protector ends between the rectilinear and parallel protrusions 9a and 11a against the protrusions, also rectlinear, 5–5a of flanges 2–2a, and inserting then tangs 9, 10 and 11 of the chin protector within the corresponding windows 4–4a–4b provided on the cap flanges and locking thereafter the chin protector ends to the flange, by hand tightening, without utilizing any tool, the threaded bolt 14.

The stability of the locking is ensured by the association of the tangs inserted in the flange windows, the engagement among one another of the rectilinear ribs 9a–11a of the chin protector against the rectilinear protrusions 5–5a provided on the cap flanges, and the locking of bolt 14.

The rigidity of the engagement of the tangs within the respective windows is ensured in this embodiment by the inclined pull of bolt 14, which, during the tightening, submits the tangs to traction against the innermost window side relatively to the coupling seats 3a; besides, the presence of tube 30, also outwards inclined, mantains a given inclination of flanges 2–2a relatively to the chin protector ends; as a consequence, seats 3a, being slightly angular relatively to the chin protector seats, contribute to the stability of the engagement between the tangs and the relative windows.

The interposition of gasket 14b from elastic material ensures the graduality of the tightening of the locking means in its seat, with no deformation risk for said seat.

In practice, it has been found that the combination of said engagement elements between the chin protector and the cap and the inclination of the tube and its tightening in inclined direction relatively to the coupling flat seat, makes it possible to obtain a locking rigidity sufficient to satisfy the requirements of the regulations on integral helmets.

The disassembly of the chin protector in made in a quick and easy way, by hand unscrewing bolts 14 provided with knurled heads, and by removing the chin protector tangs from the respective windows of the cap flanges.

Lastly, always according to this invention, two equal cover and finishing plates 20 are provided, which are shaped in the same way as the matching zones 3a of each end of flanges 2–2a and which are appliable to the latter by means of said bolts 14, when the chin protector is removed and the helmet is utilized as a "Jet"-helmet.

Obviously, modifications and changes equivalent as concerns the construction and the function, may be introduced in the practical embodiments, which fall always within the protection scope of this invention.

I claim:

1. Crash-helmet for motorcyclists and sport-competitions comprising a frontally open rigid cap and a rigid chin protector, removable and fastenable to said cap by means of coupling, holding and hand operatable locking means, said removable chin protector being fastened to said cap in seats provided within flanges protruding from the base of said cap and housed within the thickness of the flanges due to a reduction in the thickness of said flanges by an association of snap coupling and holding devices with stable locking means, said snap coupling devices and said locking means being correspondingly provided on the opposing faces of said flanges protruding from the cap base and on the faces of the end of said chin protector, so as to realize the coupling between said flange and said protector ends by partial superposition of same, and upon removal of the chin protector, so as to obtain a "jet"-like open helmet, and, so as to obtain by a chin protector stably locked to the cap, an integral helmet; and said snap coupling and holding devices are constituted by rectilinear ribs, provided on the cap flanges and sliding along corresponding guides protruding from the end faces of the chin protector, and by tangs provided on the chin protector, which are snap-embeddable into corresponding windows provided in the cap flanges, or by tangs provided on the double flanges which are snap-embeddable into corresponding windows provided in the chin protector ends.

2. Crash-helmet according to claim 1, wherein said stable locking means are constituted by at least a bolt, a stud, or a pin fastenable by hand-operatable means by screwing, or bayonet jointing, and which passes through said flanges and said ends superposed on one another.

3. Crash-helmet according to claim 1, wherein said seats of said flanges protruding from the cap and those at the end of the chin protector have a reduced or decreasing thickness, to obtain, upon superposition of same, the continuity of the external surface between the chin protector and the cap flanges.

4. Crash-helmet according to claim 1, wherein the end edge of the chin protector ends follows a broken line forming a plurality of substantially wedge-shaped corners, suitable to be stably housed, both axially and transversally, within corresponding flarings provided inside the seats of said cap flanges.

5. Crash-helmet according to claim 1, wherein a hand-operatable stable locking means is provided with a gasket from elastically yielding material placed between said means and a seat of said means.

6. Crash-helmet for motorcyclists and sport-competitions comprising a frontally open rigid cap and a rigid chin protector, removable and fastenable to said cap by means of coupling, holding and hand operatable locking means, said removable chin protector being fastened to said cap in seats provided within flanges protruding from the base of said cap and housed within the thickness of the flanges due to a reduction in the thickness of said flanges by an association of snap coupling and holding devices with stable locking means, said snap coupling devices and said locking means being correspondingly provided on the opposing faces of said flanges protruding from the cap base and on the faces of the end of said chin protector, so as to realize the coupling between said flange and said protector ends by partial superposition of same, and upon removal of the chin protector, so as to obtain a "jet"-like open helmet, and, so as to obtain by a chin protector stably locked to the cap, an integral helmet;

a through-hole is provided on the seat of the chin protector ends, to which hole an outwardly inclined tube is associated, inside of which a tubular threaded insertion is provided for the tightening of the chin protector end on to the cap flanges by means of said locking means.

7. Crash-helmet according to claim 6, wherein said stable locking means are constituted by at least a bolt, a stud, or a pin fastenable by hand-operatable means by screwing, or bayonet jointing, and which passes through said flanges and said ends superposed on one another.

8. Crash-helmet according to claim 6, wherein said seats of said flanges protruding from the cap and those at the end of the chin protector have a reduced or decreasing thickness, to obtain, upon superposition of same, the continuity of the external surface between the chin protector and the cap flanges.

9. Crash-helmet according to claim 6, wherein the end edge of the chin protector ends follows a broken line forming a plurality of substantially wedge-shaped corners, suitable to be stably housed, both axially and transversally, within corresponding flarings provided inside the seats of said cap flanges.

10. Crash-helmet according to claim 6, wherein a hand-operatable stable locking means is provided with a gasket from elastically yielding material placed between said means and a seat of said means.

11. Crash-helmet for motorcyclists and sport-competitions comprising a frontally open rigid cap and a rigid chin protector, removable and fastenable to said cap by means of coupling, holding and hand operatable locking means, said removable chin protector being fastened to said cap in seats provided within flanges protruding from the base of said cap and housed within the thickness of the flanges due to a reduction in the thickness of said flanges by an association of snap coupling and holding devices with stable locking means, said snap coupling devices and said locking means being correspondingly provided on the opposing faces of said flanges protruding from the cap base and on the faces of the end of said chin protector, so as to realize the coupling between said flange and said protector ends by partial superposition of same, and upon removal of the chin protector, to obtain a "jet"-like open helmet, and, so as to obtain by a chin protector stably locked to the cap, an integral helmet; and two equal plates being cover maskings having the same shape as the cap flanges, suitable to be inserted and locked on said seats upon removal of the chin protector, for reasons of aesthetical finishing and to ensure the aerodynamical continuity and absence of unevenness of the helmet surface.

12. Crash-helmet according to claim 11, wherein said stable locking means are constituted by at least a bolt, a stud, or a pin fastenable by hand-operatable means by screwing, or bayonet jointing, and which passes through said flanges and said ends superposed on one another.

13. Crash-helmet according to claim 11, wherein said seats of said flanges protruding from the cap and those at the end of the chin protector have a reduced or decreasing thickness, to obtain, upon superposition of same, the continuity of the external surface between the chin protector and the cap flanges.

14. Crash-helmet according to claim 11, wherein the end edge of the chin protector ends follows a broken line forming a plurality of substantially wedge-shaped corners, suitable to be stably housed, both axially and transversally, within corresponding flarings provided inside the seats of said cap flanges.

15. Crash-helmet according to claim 11, wherein a hand-operatable stable locking means is provided with a gasket from elastically yielding material placed between said means and a seat of said means.

* * * * *